US006754929B2

(12) United States Patent
Fichter

(10) Patent No.: US 6,754,929 B2
(45) Date of Patent: Jun. 29, 2004

(54) COMPACT BACK MAINTENANCE DEVICE

(76) Inventor: Nancy Fichter, 303 Central Ave., North Hills, PA (US) 19038

( * ) Notice: Subject to any disclaimer, the term of this patent is extended or adjusted under 35 U.S.C. 154(b) by 368 days.

(21) Appl. No.: 09/925,082

(22) Filed: Aug. 8, 2001

(65) Prior Publication Data

US 2003/0028984 A1 Feb. 13, 2003

(51) Int. Cl.[7] ..... A47L 13/12

(52) U.S. Cl. ..... 15/114; 15/184; 15/144.4; 15/111

(58) Field of Search ..... 15/106, 107, 110, 15/111, 244.1, 244.3, 244.4, 114, 184, 144.4, 159.1, 186, 144.1

(56) References Cited

U.S. PATENT DOCUMENTS

| | | | | | |
|---|---|---|---|---|---|
| 2,116,864 | A | * | 5/1938 | Fehrenbach | 401/24 |
| 2,641,012 | A | * | 6/1953 | Storrs | 15/144.4 |
| 2,651,070 | A | * | 9/1953 | Zimmerman | 15/185 |
| 3,103,682 | A | * | 9/1963 | Markle | 15/244.1 |
| 3,188,675 | A | * | 6/1965 | Beck | 15/244.1 |
| 3,690,331 | A | * | 9/1972 | Messer | 132/120 |
| 4,336,623 | A | | 6/1982 | Lin | 15/222 |
| 4,508,108 | A | | 4/1985 | Miyaoka | 128/65 |
| 5,810,027 | A | * | 9/1998 | Frantzeskakis | 132/320 |
| 5,875,511 | A | | 3/1999 | Nejdl | 15/176.1 |
| 5,960,509 | A | | 10/1999 | Wu | 15/244.2 |
| 6,510,577 | B1 | * | 1/2003 | Borcherds et al. | 15/118 |

* cited by examiner

*Primary Examiner*—Robert J. Warden, Sr.
*Assistant Examiner*—Shay L Balsis
(74) *Attorney, Agent, or Firm*—Michael G. Crilly, Esq.

(57) ABSTRACT

The present invention is a personal hygiene device. Specifically, the invention is a back maintenance device comprised of a brush head attached to a variable length handle. The brush head is attached to at least one abrasive element. In an alternate embodiment, a second abrasive element is attached to the brush head. Abrasive elements include bristle and porous structures. The variable length handle is both extendible from and retractable into a storage cavity within the brush head. The variable length handle is telescoping. One embodiment consists of fixed length tubular members slidably disposed and extending to form a rigid handle structure. An alternate embodiment consists of a coiled member slidably disposed along its length and extending to form a rigid handle structure.

1 Claim, 6 Drawing Sheets

COMPACT BACK MAINTENANCE DEVICE

CROSS-REFERENCE TO RELATED APPLICATIONS

None

FEDERALLY SPONSORED RESEARCH AND DEVELOPMENT

No Government License Rights

BACKGROUND OF THE INVENTION

1. Field of the Invention

The present invention generally relates to a compact back maintenance device. The invention specifically describes a back brush with an extendible handle and a brush head wherein said handle is stored.

2. Background of the Invention

Proper back maintenance generally requires one or more devices to scratch, scrub, or rub an area of the body not effectively reached because of mobility restrictions inherent to the human arm. Most back brushes include a handle to access the entire back. Such devices are long with a majority of this length occupied by the handle. It is not uncommon for a back brush to have a length ratio, handle-to-brush head, in excess of three.

Back brushes include both fixed and variable length devices. Nejdl, in U.S. Pat. No. 5,875,511 issued on Mar. 2, 1999, describes and claims a fixed length device. Unfortunately, fixed length back brushes by their very nature provide neither the range of leverage nor the control required to effectively maintain the entire back surface. Furthermore, the size and shape of such devices do not lend themselves to travel.

Various examples are cited in the related art facilitating the adjustment of back brush length. No single device provides the compactness, adjustability, elegance of design, and simplicity of use of the present invention.

Miyaoka, in U.S. Pat. No. 4,508,108 issued on Apr. 2, 1985, describes and claims a back brush with a fixed length handle slidably disposed within a brush head. A portion of the handle length, slightly less than the length of the brush head, is stowed within the brush head. While Miyaoka attempts to address the issue of storage length, it provides a fifty percent reduction in total brush length at best in its retracted state. Furthermore, leverage and control adjustments are limited to the length of the brush head.

Wu, in U.S. Pat. No. 5,960,509 issued on Oct. 5, 1999, describes and claims a multi-functional back brush with two-piece handle pivotally connected to allow adjustable rotation. In general, the claimed handle design provides improved leverage and control adjustments. However, the invention fails to provide a volume efficient envelope when the device is not in use.

Lin, in U.S. Pat. No. 4,336,623 issued on Jun. 29, 1982, describes and claims a bathing brush having a pair of opposed retractable handles each connected to the brush body by a set of strings, with a spring-based retracting means located within said body. Unlike the present invention, Lin neither provides for the complete storage of the handle nor achieves storage in a mechanically simple manner. Furthermore, Lin relies on a flexible member, more specifically a string, to facilitate storage of the handle. In doing so, Lin requires two hand grips to properly control and operate the device.

The related art clearly demonstrates the limits of existing back brushes. What is currently required is a back maintenance device with a rigid, adjustable length handle to optimize leverage and control. What is currently required is a back maintenance device that stows a variable length handle within the brush head thereby minimizing device volume when not in use. What is currently required is a device that facilitates compactability and adjustability in a mechanically simple design that remains easy to use.

SUMMARY OF THE INVENTION

It is therefore an object of the present invention to avoid the disadvantages of the related arts. More particularly, it is the object of the invention to provide a back maintenance device with an adjustable length handle to optimize leverage and control of a brush head. It is also the object of the invention to provide a back maintenance device that facilitates storage of the brush handle within the brush head envelope. It is a further object of the invention to provide a compactable and adjustable brush handle that is both mechanically simple and easy to use.

The present invention is a personal hygiene device. Specifically, the invention is a back maintenance device comprised of a brush head attached to a variable length handle.

The brush head facilitates scratching, scrubbing, or rubbing of the human torso. In the preferred embodiment, one abrasive element is attached to the brush head. In an alternate embodiment, a second abrasive element is attached to the brush head. Abrasive elements may include bristle and porous structures.

The variable length handle is both extendible from and retractable into a storage cavity within the brush head. The variable length handle is telescoping. In the preferred embodiment, the handle is composed of two or more fixed length tubular members slidably disposed and extending to form a rigid handle structure. In an alternate embodiment, the handle is composed of a coiled member slidably disposed along its length and extending to form a rigid handle structure.

In alternate embodiments, a protective cover is provided over one or both abrasive elements. The protective cover is secured to the brush head via a mechanical attachment. When two covers are desired, both covers may be secured to the brush head or covers attached to one another. Cover design prevents damage to the underlying bristle and sponge.

The present invention offers several advantages over the related arts. First, the extendible handle facilitates a compact storage envelope by the back maintenance device when not in use. Specifically, retraction of the handle into a cavity within the brush head achieves a handle-to-brush-head length ratio approximately no greater than one. The present invention thereby provides the extension required to completely access the entire torso, yet eliminates the bulk found in the related arts. The present invention is more compatible with volume critical activities, one example including travel. Second, the variable length handle and brush head arrangement enables a user to optimize scratching, scrubbing, or rubbing motion in a specific area. Specifically, the handle is extendible to the extent required to optimize leverage and control of the brush head within the desired area. This feature eliminates the awkwardness created when handle length exceeds an optimum extension length for the intended use.

REFERENCE NUMERALS

Figure 1:
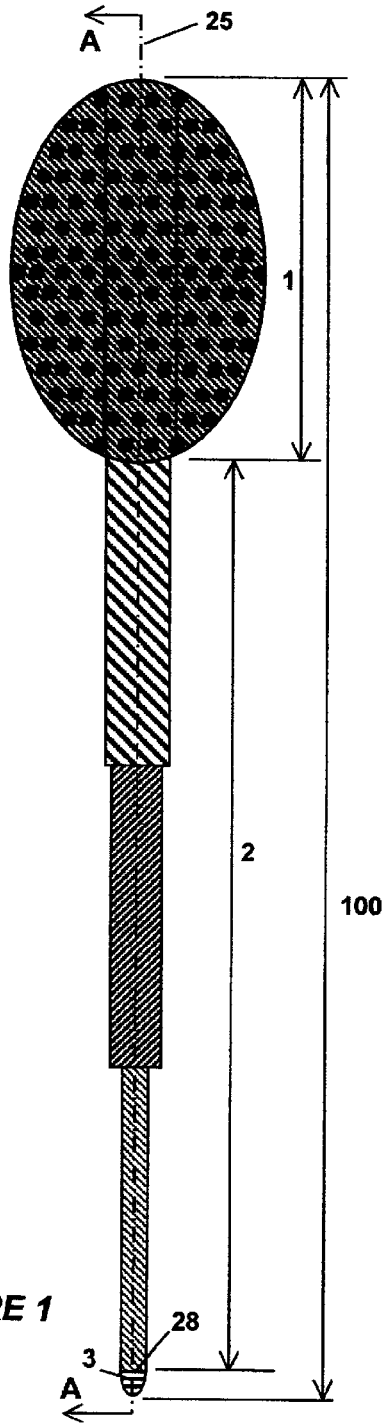
FIG. 1 is a schematic diagram describing the preferred embodiment of the present invention in its extended form.

1 Brush head
2 Variable length handle
3 Grip
4 Storage cavity
5 Upper tubular member
6 Middle tubular member
7 Lower tubular member
8 Bristle
9 Lower locking element
10 Upper locking element
11 Bulkhead
12 Planar member
13 Tube
14 Coiled member
15 Second abrasive element
16 Stop
17 First abrasive element
20 First surface
21 Second surface
23 First cover
24 Second cover
25 Central axis
26 Outward flange
27 First end
28 Second end
29 Inward flange
30 Relative motion lock
31 Outer wall
32 Inner wall
33 First segment
34 Second segment
39 Open end
41 Cover wall
42 Perimeter
43 Second cover wall
44 Snap fit tab
45 Snap fit track
46 Vent hole
100 Back maintenance device

DESCRIPTION OF THE INVENTION

Figure 2:
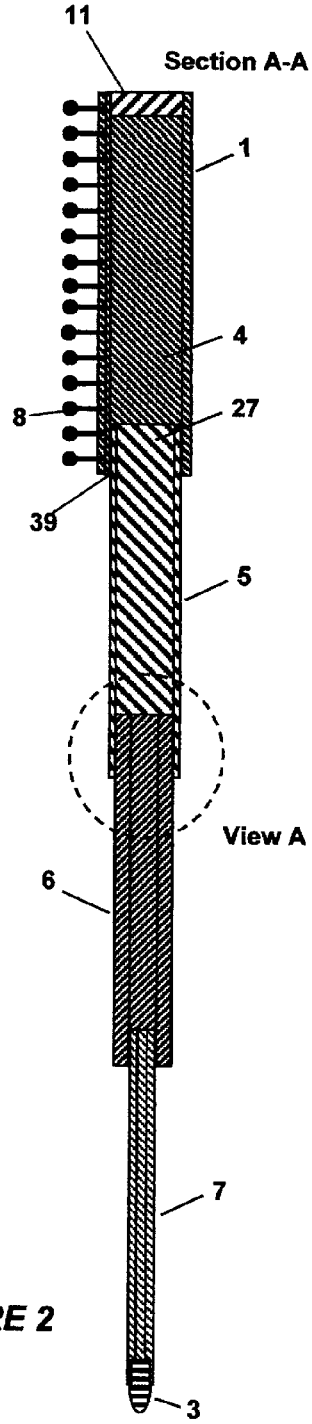
FIG. 2 is a section view of the present invention in its extended form.

Illustrations of the present invention are provided in FIGS. 1 and 2. The back maintenance device 100 consists of a brush head 1, a variable length handle 2, and a grip 3. The variable length handle 2 has a first end 27 secured to the brush head 1 and a second end 28 attached to the grip 3. The grip 3 may be attached via mechanical means such as threads or bonded using a commercially available adhesive. Brush head 1, variable length handle 2, and grip 3 are fabricated from materials including polymer, wood, or metal. In the preferred embodiment, brush head 1, variable length handle 2, and grip 3 are symmetrically arranged about a common central axis 25.

The primary functions of the brush head 1 include securing an abrasive material to the variable length handle 2 and providing a storage cavity 4 for the variable length handle 2 in its retracted form. The variable length handle 2 provides the range of motion and control required to maximize function of the abrasive material along the brush head 1 against the torso. Abrasive materials include but are not limited to bristle and porous structures.

The grip 3 facilitates extension of the variable length handle 2. Grip 3 design, namely shape and surface texture, insures sufficient frictional contact between fingers and grip 3 to facilitate extension of the variable length handle 2. Grip 3 design may include any shape providing sufficient surface area to maintain finger contact, one example is shown in FIG. 1. Grip 3 texture prevents sliding motion between fingers and grip 3 and must be sufficiently coarse enabling user to extend the variable length handle 2 from the storage cavity 4 and to interlock the tubular members 5, 6, and 7.

A user grasps the grip 3 with two or more fingers and pulls the variable length handle 2 away from the brush head 1 thereby extending the variable length handle 2 from the storage cavity 4. Complete as well as partial extension of the variable length handle 2 is possible. The variable length handle 2 is retracted by exerting a force on the grip 3 or along one or more tubular members 5, 6, 7 towards the brush head 1.

FIG. 2 provides a detailed cross section view of the preferred embodiment with variable length handle 2 fully extended. The brush head 1 includes a storage cavity 4 of sufficient volume and length to stow the variable length handle 2 in its retracted form. At one end of the cavity is a bulkhead 11 with the opposed end referred to as an open end 39. The bulkhead 11 is attached to the brush head 1 via a mechanical attachment such as threads or bonded with a commercially available adhesive. The bulkhead 11 confines the variable length handle 2 within the storage cavity 4.

The bulkhead 11 also facilitates assembly of the variable length handle 2 into the storage cavity 4 during manufacture. The bulkhead 1 is removed from the brush head 1, the variable length handle 2 is assembled and inserted into the storage cavity 4. Thereafter, the bulkhead 11 is attached to the brush head 1.

A typical variable length handle 2 consists of at least two tube-shaped members. FIG. 2 describes a tri-member arrangement consisting of an upper tubular member 5, a middle tubular member 6, and a lower tubular member 7. The upper tubular member 5 is slidably disposed within the storage cavity 4. The middle tubular member 6 is slidably disposed within the upper tubular member 5. The lower tubular member 7 is slidably disposed within the middle tubular member 6.

Adequate control over and leverage of the brush head 1 requires the variable length handle 2 to form a rigid structure. A rigid structure is achieved by eliminating rotational and longitudinal motion between brush head 1 and upper tubular member 5, as well as at connections between upper tubular member 5, middle tubular member 6, and lower tubular member 7.

Figure 3:
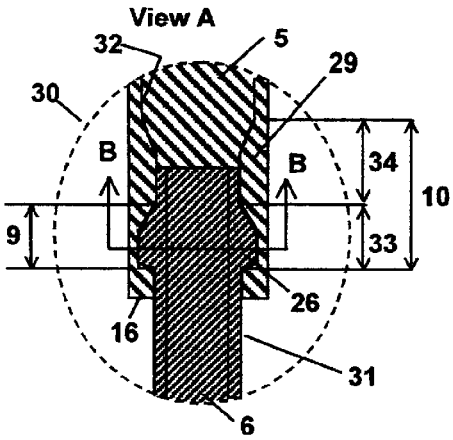
FIG. 3 is a section view of the relative motion lock.
Figure 4:
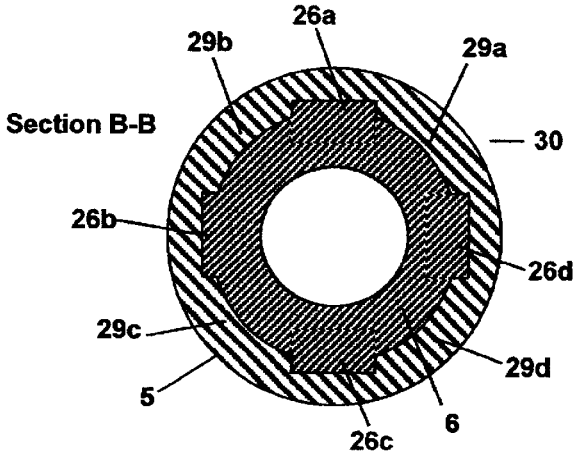
FIG. 4 is a section view of the relative motion lock.

FIG. 3 describes a representative relative motion lock 30 consisting of a lower locking element 9 and an upper locking element 10. The lower locking element 9 includes at least one outward flange 26 along a portion of the circumference of the inner wall 32 at one end of each tubular member 5, 6, 7 and protruding from the outer wall 31. The upper locking element 10 consists of an inward flange 29 positioned at the end opposite to the outward flange 26 in both upper tubular member 5 and middle tubular member 6, as well as adjacent to the open end 39 of the storage cavity 4. The upper locking element 10 protrudes from the inner wall 32 thereby forming a first segment 33 and a second segment 34. The first segment 33 is a reverse profile of the outward flange 26. When outward flange 26 and first segment 33 are joined they eliminate both longitudinal and rotational motion between tubular members 5 and 6, 6 and 7, and between brush head 1 and upper tubular member 5. FIG. 4 shows the interlocking profile formed between four outward flanges 26 and complimentary inward flanges 29. Along the second segment 34, the inward flange 29 completely surrounds the circumference of the inner wall 32 and guides the outward flange 26 into the first segment 33 for locking. A stop 16 restricts extension between tubular members 5–6, 6–7 thereby avoiding separation and providing sufficient overlap to further stiffen the structure. A stop 16 is located at the open end 39 of the storage cavity 4 thereby preventing separation between brush head 1 and upper tubular member 5. A typical stop 16 is comprised of a collar-like structure about the circumference of and attached to the inner wall 32 of tubular members 5 and 6.

Figure 5:
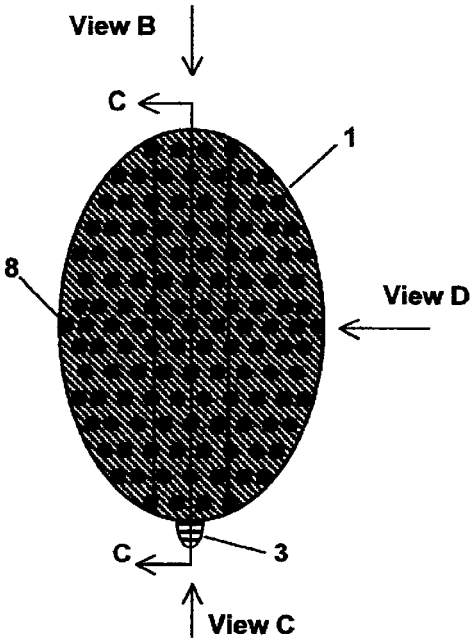
FIG. 5 is a frontal view of the present invention in its retracted form.
Figure 6:
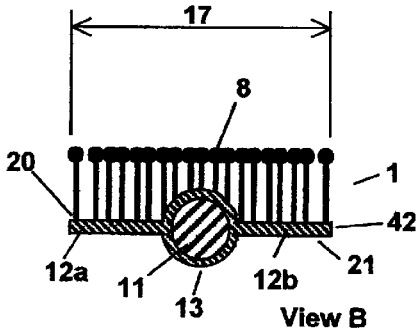
FIG. 6 is a top view of the present invention.
Figure 7:
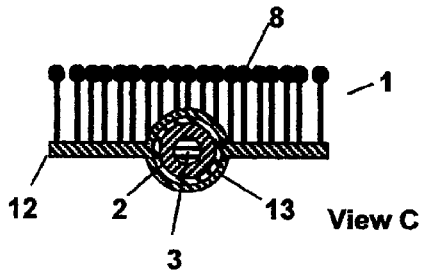
FIG. 7 is a bottom view of the present invention.
Figure 8:
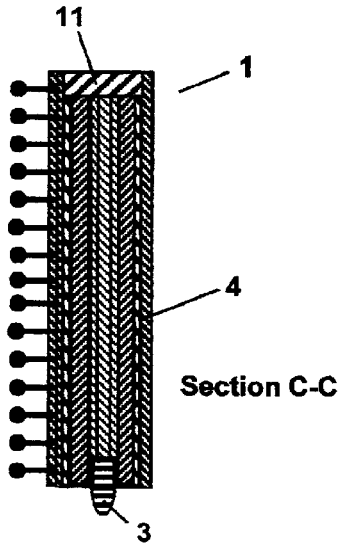
FIG. 8 is a section view of the present invention in its retracted form.
Figure 9:
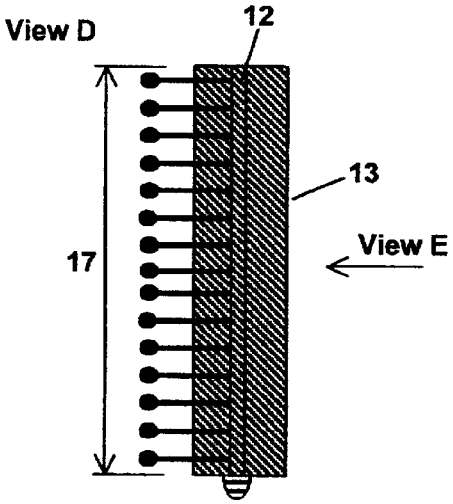
FIG. 9 is a side view of the present invention in its retracted form.
Figure 10:
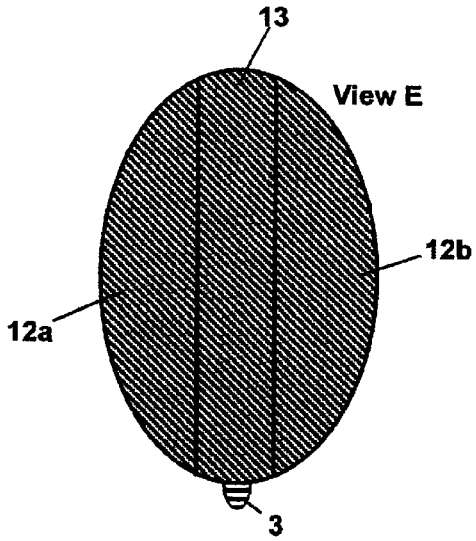
FIG. 10 is a back view of the present invention in its retracted form.

FIGS. 5 through 10 describe details of the preferred embodiment of the brush head 1 in its retracted form. The brush head 1 is comprised of a planar member 12 and a tube 13. FIG. 6 shows a segmented planar member 12 about a tube 13. In the preferred embodiment, both planar member 12 and tube 13 are fabricated from a single piece of material. However, planar member 12 and tube 13 may be separately fabricated and thereafter joined to form the desired structure. The tube 13 is similar in profile to the upper tubular member 5. The brush head 1 thereby formed by planar member 12 and tube 13 has a first surface 20 and a second surface 21, as shown in FIGS. 5 and 10, respectively. In the preferred embodiment, a first abrasive element 17 is attached to the first surface 20. In an alternate embodiment, a second abrasive element 15 is attached to the second surface 21. Abrasive elements 15, 17 are attached to surfaces 20, 21 with a commercially available adhesive or by mechanical attachment. For example, FIGS. 5 and 9 show the first surface 20 with a plurality of bristles 8, thereby forming a first abrasive element 17, embedded within the brush head 1. Alternate embodiments of the present invention might include a sponge or luffa as either the first abrasive element 17 or the second abrasive element 15 or both. Additional embodiments include an attachment method wherein first abrasive element 17 and second abrasive element 15 are secured to the brush head 1 in a readily removable manner, one example including Velcro®.

FIGS. 7 and 8 show the brush head 1 with variable length handle 2 stowed within the storage cavity 4. The variable length handle 2 remains in the storage cavity 4 via mechanical means. For example, an interference fit between outer walls 31 and inner walls 32 as well as between outer wall 31 of the upper tubular member 5 and storage cavity 4 secures the variable length handle 2 to the brush head 1 in its retracted form. Alternatively, frictional locking between tubular members 5 and 6, 6 and 7 and an upper tubular member 5 and storage cavity 4 prevents undesired extension of the variable length handle 2 when stowed.

Figure 11:
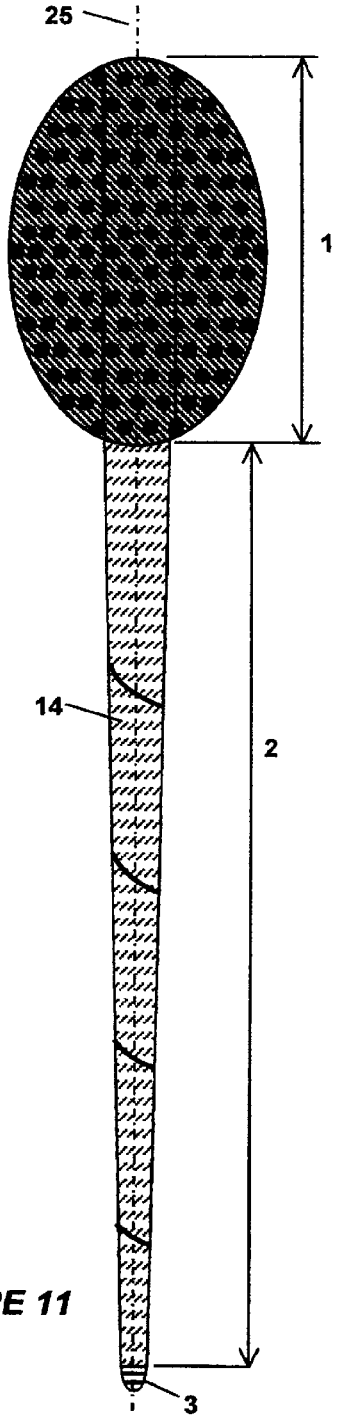
FIG. 11 is a schematic diagram describing an alternate embodiment of the present invention in its extended form.
Figure 12:
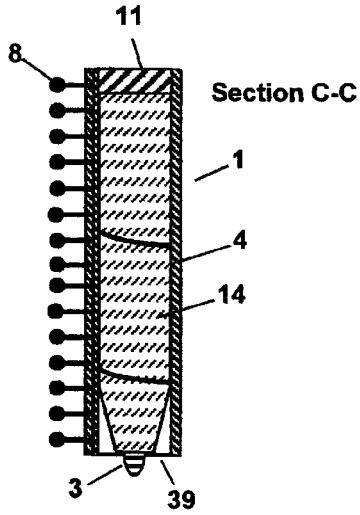
FIG. 12 is a section view of the present invention in its retracted form
Figure 13:
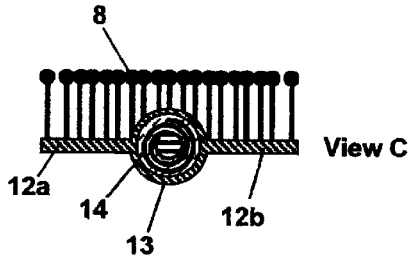
FIG. 13 is a bottom view of an alternate embodiment of the present invention.

FIGS. 11 through 13 describe an alternate embodiment of the present invention. The variable length handle 2 is composed of a coiled member 14 of flexible material that remains sufficiently rigid to prevent flexure about the central axis 25 when extended. One end of the coiled member 14 is secured to a brush head 1 as described above for the tubular members 5, 6, and 7. The other end of the coiled member 14 is attached a grip 3 as likewise described above.

The user extends the variable length handle 2 by grasping the grip 3 and pulling it away from the brush head 1. This motion telescopes the coiled member 14 in the direction of the applied force thereby forming a frustum or conical shape. Sufficient overlap of material along the coiled member 14 insures structural integrity and rigidity. FIG. 11 shows the coiled member 14 extended thereby forming the variable length handle 2. Likewise, the variable length handle 2 is retracted, causing the coiled member 14 to return to is original shape, by applying a force on the grip 3 in the direction of the brush head 1. FIGS. 12 and 13 show the coiled member 14 stowed within the storage cavity 4.

Figure 14:
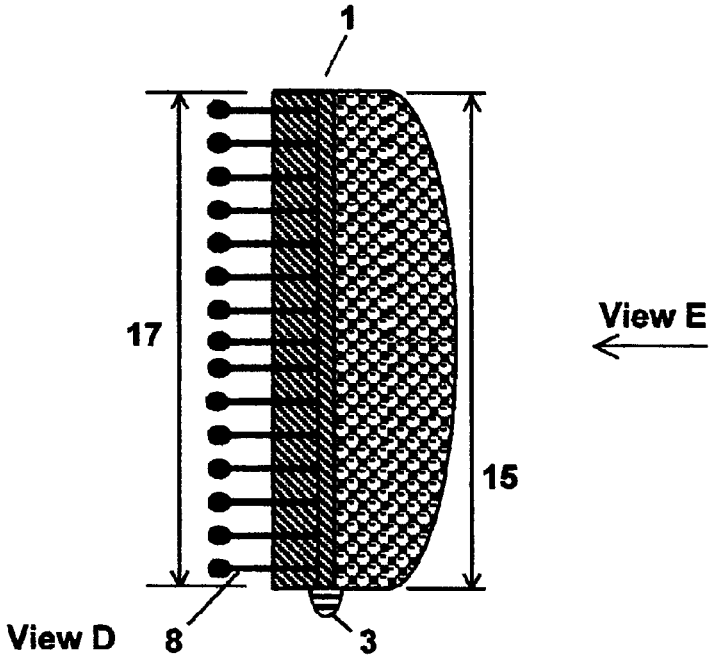
FIG. 14 is a side view of the present invention showing bristles and porous element.
Figure 15:
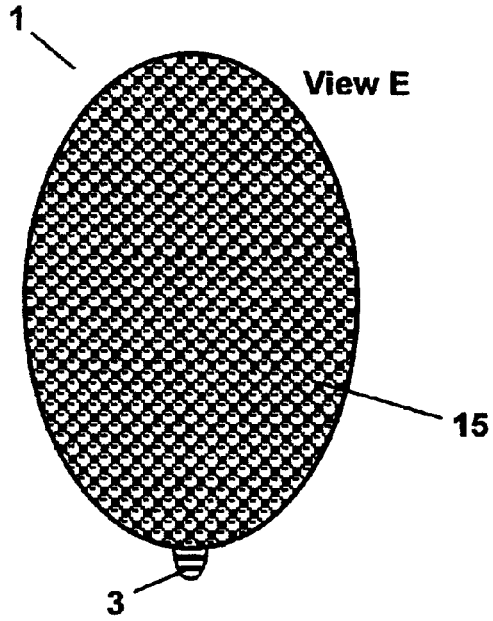
FIG. 15 is a back view of the brush head showing porous element.

Various abrasive materials and combinations thereof are possible in the present invention. The preferred embodiment includes a plurality of bristles 8, as shown in FIG. 9. An alternate embodiment is shown in FIGS. 14 and 15 and comprised of a first abrasive element 1 with a plurality of bristles 8 and a second abrasive element 15 being a porous material, one example including a sponge.

Figure 16:
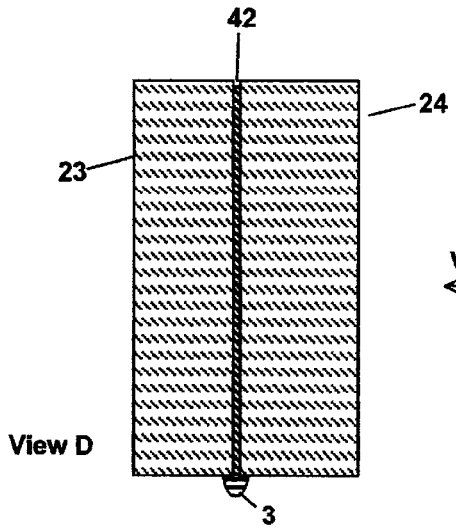
FIG. 16 is a schematic diagram of brush head with covers.
Figure 17:
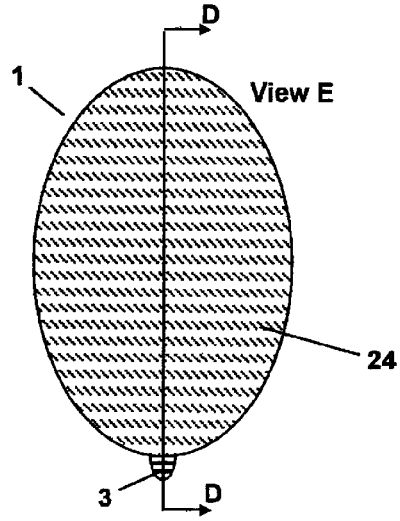
FIG. 17 is a back view of brush head with cover.
Figure 18:
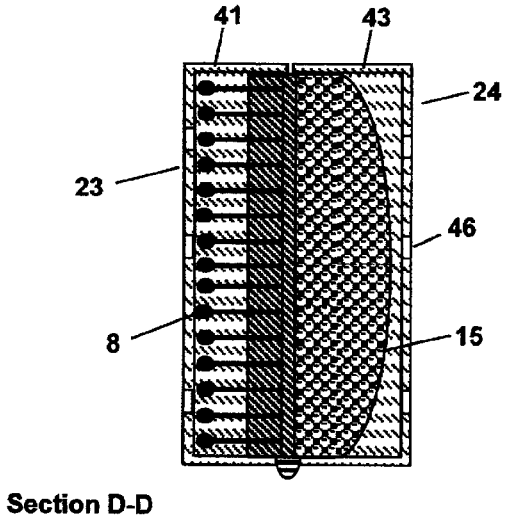
FIG. 18 is a section view of brush head showing bristles, porous element, and covers.
Figure 19:
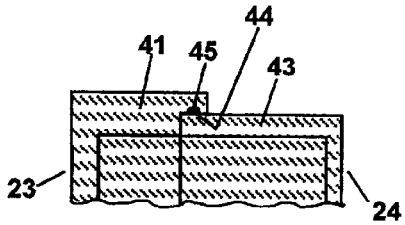
FIG. 19 is a schematic diagram of a representative mechanical attachment for brush head covers.

In alternate embodiments, one or two covers 23, 24 are attachable to the brush head 1 when not in use to protect the underlying abrasive elements 15, 17 and to prevent the accumulation of foreign particles. FIGS. 16, 17, and 18 show a first cover 23 and a second cover 24 attached to a brush head 1 thereby shielding the first abrasive element 17 and the second abrasive element 15. An alternate embodiment of the covers 23, 24 include one or more vent holes 46 to facilitate ventilation of the underlying abrasive elements 15, 17. Covers 23, 24 are secured to the brush head 1 via a snap or interference fit between the cover wall 41 and perimeter 42 of the planar member 12. Alternatively, snap or interference fit many occur between covers 23, 24. For example, a snap fit tab 44 may be located along the length of the second cover wall 43 with a corresponding snap fit track 45, a cavity of similar shape to the snap fit tab 44, along the length of the cover wall 41, as shown in FIG. 19.

The description above indicates that a great degree of flexibility is offered by described members, elements, and features of the device. Although the present invention has been described in considerable detail with reference to certain preferred versions thereof, other versions are possible. Therefore, the spirit and scope of the appended claims should not be limited to the description of the preferred versions contained herein.

What is claimed is:

1. A compact back maintenance device comprising:

(a) a brush head, said brush head having a first side, a second side, and a storage cavity between said first side and said second side;

(b) a first abrasive element composed of a plurality of bristles attached along and perpendicular to said first side;

(c) a second abrasive element composed of a luffa attached to said second side;

(d) a variable length handle composed of a coiled member slidably disposed and telescoping, said variable length handle having a first end and a second end, said first end secured to said brush head, said variable length handle both extendible from and retractable into said storage cavity, said variable length handle forming a rigid structure when extended, said variable length handle no longer than said brush head when retracted; and (e) a grip attached to said second end of said handle.

* * * * *